United States Patent [19]

Nalick

[11] 4,075,813

[45] Feb. 28, 1978

[54] DOME CONSTRUCTION METHOD

[76] Inventor: David L. Nalick, 10789 Freer St., Temple City, Calif. 91780

[21] Appl. No.: 705,074

[22] Filed: Jul. 14, 1976

[51] Int. Cl.[2] ..... E04B 1/32

[52] U.S. Cl. ..... 52/747; 52/81

[58] Field of Search ..... 52/80, 81, 747; 428/116, 117, 118

[56] References Cited

U.S. PATENT DOCUMENTS

| | | | |
|---|---|---|---|
| 3,133,133 | 5/1964 | Fairbanks | 428/118 |
| 3,136,380 | 6/1964 | McCoy | 428/118 |
| 3,617,416 | 11/1971 | Kromrey | 428/118 |
| 3,724,149 | 4/1973 | Detman | 52/81 |
| 3,857,150 | 12/1974 | Faacheux | 52/81 |

FOREIGN PATENT DOCUMENTS

| | | | |
|---|---|---|---|
| 1,282,156 | 12/1961 | France | 52/80 |
| 349,299 | 6/1937 | Italy | 52/81 |
| 40,492 | 12/1956 | Poland | 52/80 |

OTHER PUBLICATIONS

Mathematical Models by Candy & Rollett, ©1961, Oxford U. Press, pp. 60, 61.

*Primary Examiner*—Price C. Faw, Jr.
*Assistant Examiner*—Henry Raduazo
*Attorney, Agent, or Firm*—Gausewitz, Carr & Rothenberg

[57] ABSTRACT

A number of identical, regular, hexagonal and semi-hexagonal structural units are formed and some are interconnected in side by side abutting relation in the course of forming a dome structure of generally part spherical configuration. As the first units are interconnected, recesses are formed that are of generally distorted partial hexagonal form. Others of the structural units are then distorted as required to fit into the distorted recesses and assembly is continued to completion of the structure. The hexagonal units are readily distorted by constructing them of a number of elongated structural elements that are connected to each other in end to end relation for limited pivotal motion. The structural elements have broad outer faces that make an angle of 7½° with respect to a normal to the plane of the hexagon to facilitate abutment and interconnection of part circular rows of structural units in a generally circular configuration.

8 Claims, 13 Drawing Figures

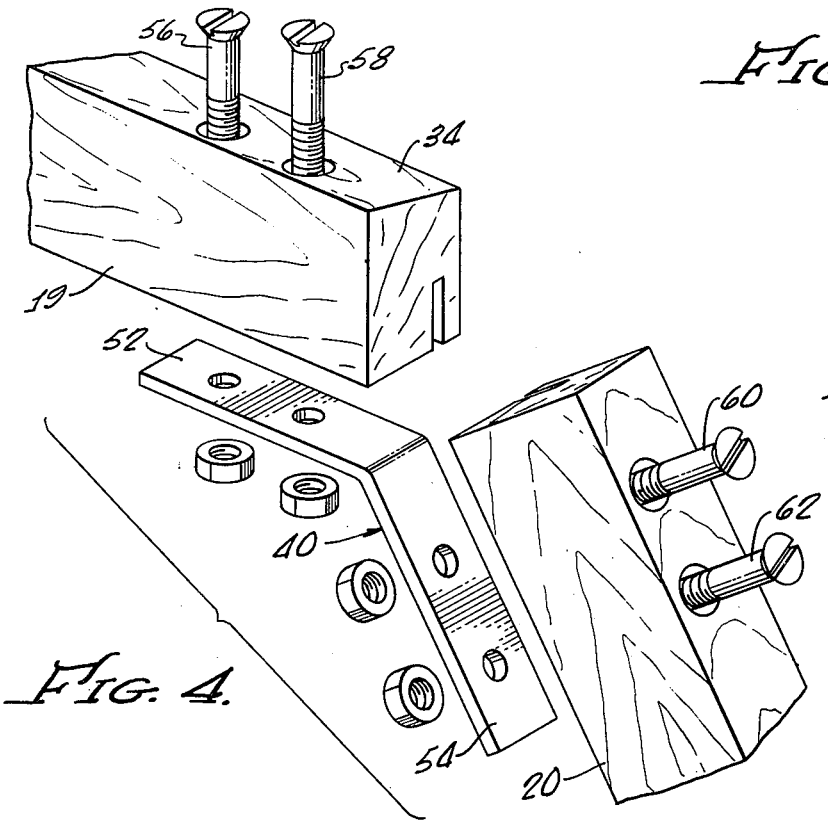
FIG. 4.
FIG. 5.
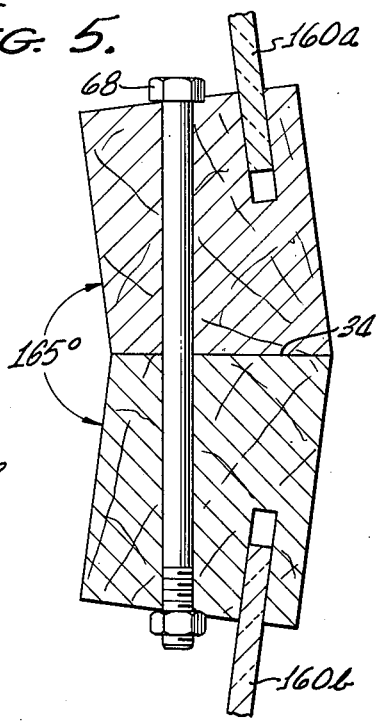
FIG. 6.
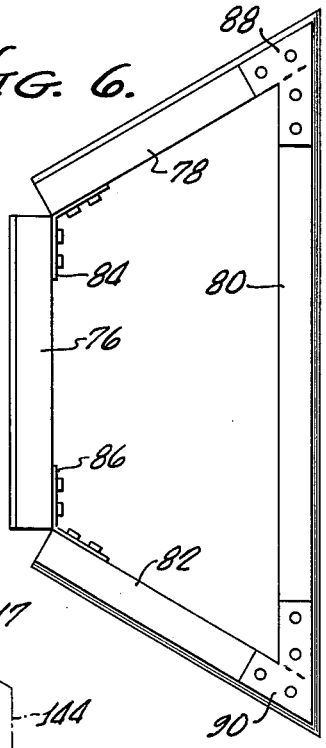
FIG. 7.
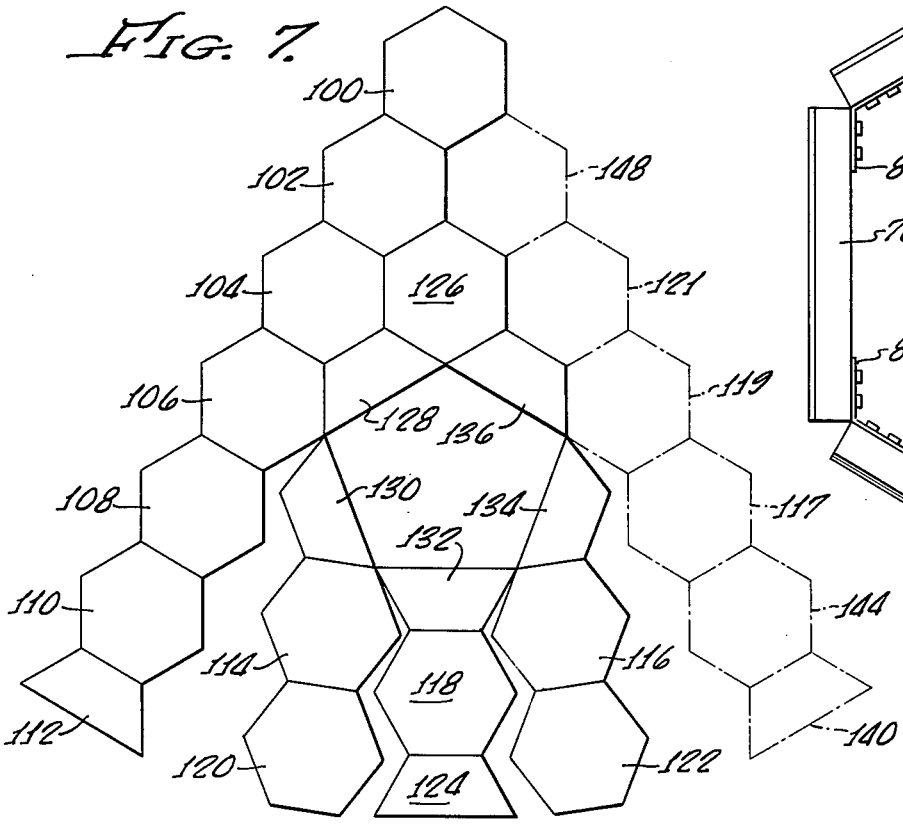

DOME CONSTRUCTION METHOD

BACKGROUND OF THE INVENTION

Dome structures, and particularly building structures employing geodesic dome arrangements, have many and well known advantages, including pleasing appearance, a large ratio of enclosed volume to enclosing surface and, especially for geodesic constructions, a large strength to weight ratio. Such structures have a high degree of stability and are capable of withstanding large stresses including high wind velocities. Yet the construction of such dome structures is expensive, difficult and time consuming. Complex and costly devices for connecting numbers of intersecting struts or panels are frequently employed, as described in the U.S. patents to Fuller, U.S. Pat. Nos. 2,682,235 and 3,197,927.

Many arrangements have been devised to form geodesic structures or dome structures from simple, planar structural elements to facilitate production of the units and to facilitate assembly into a completed structure. A number of attempts have been made to fabricate a dome structure from combinations of hexagonal and pentagonal structural units. However, because of the geometry of a sphere, it is not possible to fabricate or even approximately fabricate a sphere or part spherical structure of identical and regular hexagons.

Where simple structural units are employed in the dome fabrication, the assembly of such units is complex, difficult and time consuming, and may require complex connector elements, as in the patents to Fuller identified above, or in the patent to Emmerich, U.S. Pat. No. 3,341,989.

Efforts to build such structures of hexagons and pentagons have previously required several different shapes, different sizes, or different orientations of the elements. Thus, the patent to Langner U.S. Pat. No. 3,696,566 employs a plurality of preformed, rigid, irregular hexagons so that these hexagons can be selectively positioned in only one orientation in the course of construction.

In the patent to Martin U.S. Pat. No. 3,881,284, like the Langner patent, the dome is divided into predetermined hexagonal and pentagonal areas. However, Martin not only uses rigid irregular hexagons as in Langer, but also requires several different sizes of hexagons. Thus, not only must the structural units of Martin be precisely oriented during assembly but they must be positioned in the proper area of the finished structure. Further, it is more costly to fabricate units of many different sizes and shapes than to make a like number of identical units.

Devices of the prior art do not readily lend themselves to inexpensive and rapid mass production because of the different numbers of complex and diverse structural elements and the complexity of assembly of the structure.

Accordingly, it is an object of the present invention to provide a dome structure and a method for fabrication thereof that eliminates or minimizes above-mentioned problems.

SUMMARY OF THE INVENTION

In carrying out principles of the present invention in accordance with a preferred embodiment thereof, a dome structure is fabricated by constructing a plurality of identical regular hexagons and assemblying and interconnecting a first group of the hexagons to form part of a dome structure having distorted partial hexagonal recesses. Others of the hexagons are then distorted to fit said recesses and are assembled and interconnected with the partially assembled structure. According to a feature of the invention, the hexagons are constructed of elongated elements that are movably interconnected in end to end relation to form a distortable hexagon. According to another feature of the invention, outermost surfaces of the hexagons are formed to lie in a plane that makes an angle of $7\frac{1}{2}°$ with respect to a normal to the plane of the hexagon. The skeletal structural units are completed by a closure panel that extends across the area circumscribed by the interconnected structural elements and secured thereto for motion relative to the structural elements in the plane of the panel.

BRIEF DESCRIPTION OF THE DRAWINGS

FIG. 4 is an exploded perspective view of a movable joint between two of the elongated structural elements of a single hexagonal structural unit.

FIG. 5 is a section taken on lines 5—5 of FIG. 1.

FIG. 6 illustrates a semi-hexagonal unit employed in the dome structure of FIG. 1.

FIG. 7 is a developed view of one segment of the dome structure of FIG. 1.

DETAILED DESCRIPTION

Figure 1:
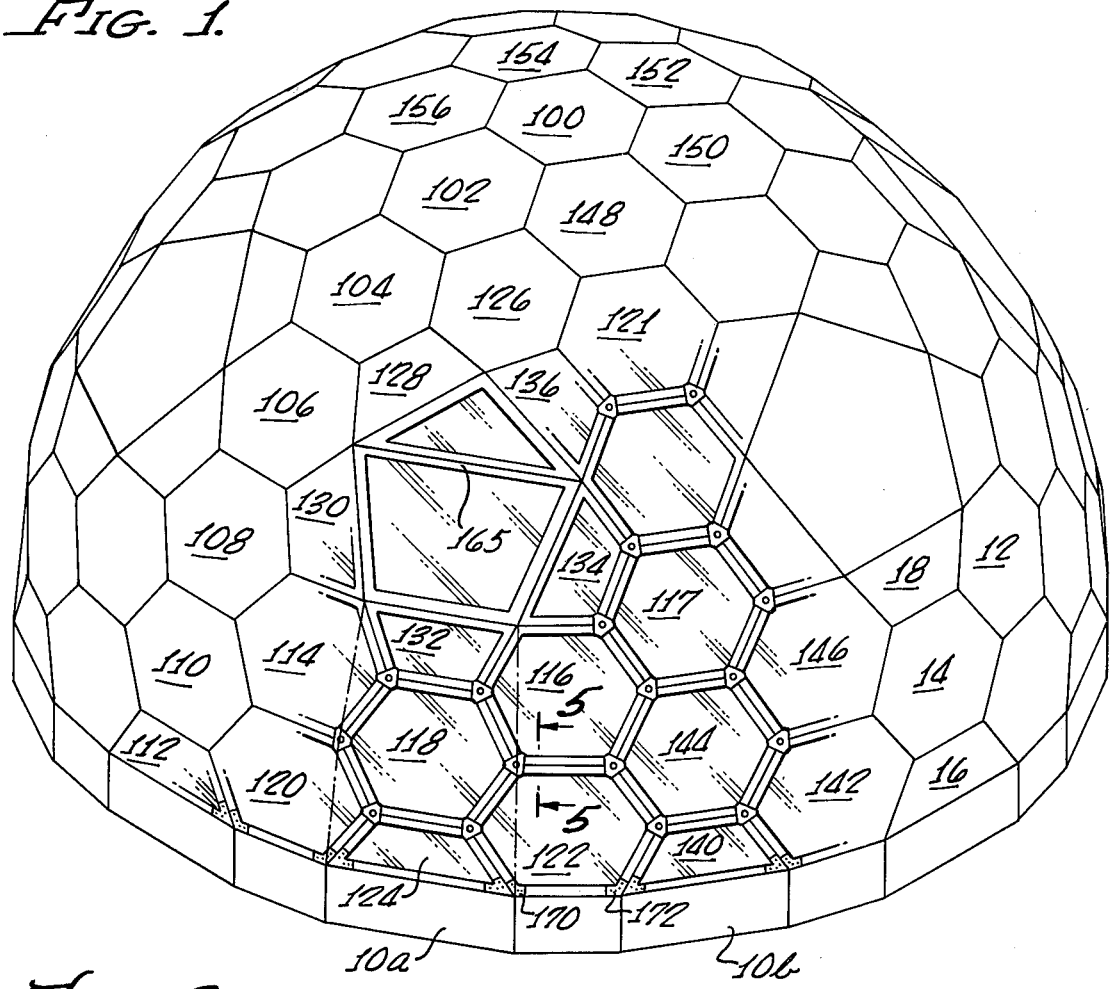
FIG. 1 is a perspective view of a dome structure embodying principles of the present invention.

Illustrated in FIG. 1 is a view of a substantially semi-spherical dome structure constructed in accordance with principles of the present invention. The structure is mounted upon a circle of foundation blocks 10*a*, 10*b*, etc. formed of any suitable foundation material and set upon any suitable ground support (not shown). A plurality of hexagonal structural units such as units 12 and 14, together with a number of semi-hexagonal units 16, 18, are fixedly connected to each other to define the structure of FIG. 1.

Figure 2:
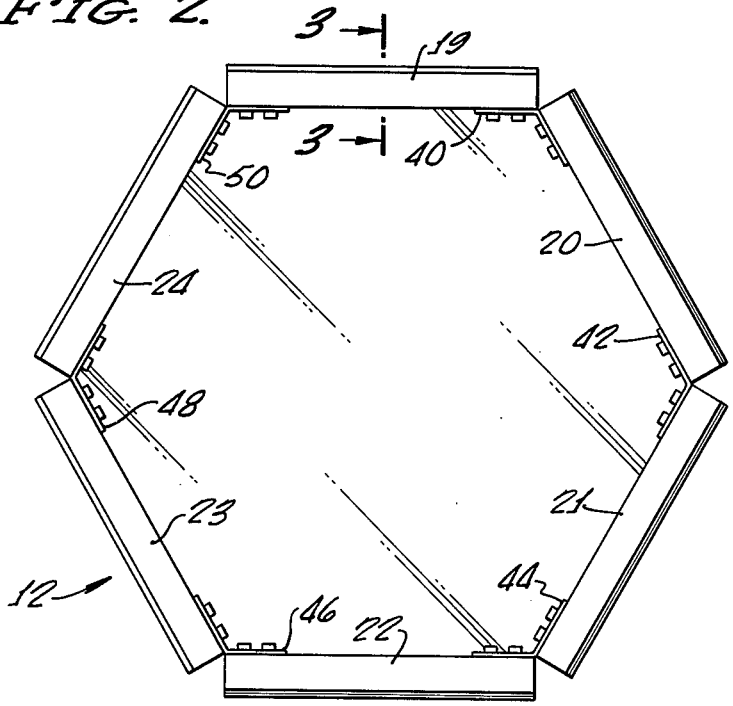
FIG. 2 illustrates a single hexagonal unit employed in the structure of FIG. 1.

As illustrated in FIG. 2, each hexagon or hexagonal structural unit is constructed as a regular hexagon. All such hexagonal units are initially identical to each other. Thus, in assembly of the dome structure, any one of a quantity of such regular, identical hexagonal structural units may be employed at any location within the structure and in any orientation relative to other structural units. This is not to say that each hexagonal unit is of a regular hexagonal shape after the dome has been assembled, nor is it to say that all hexagonal units are identical after assembly of the dome.

According to a feature of the invention, the hexagons are made so that they can be readily distorted as required for a good fit during assembly. Because the hexagonal units are made of an angularly distortable skeletal frame, they all may be identical to each other initially. All are initially of regular hexagonal shape and all are readily distorted as may be necessary or desirable during assembly of the dome structure itself. Although some of the hexagonal units need not be distorted from a regular hexagonal shape and may be formed as rigid units, a majority must be distortable and making all hexagonal units initially identical will facilitate production.

A typical one of the regular, identical and distortable hexagonal units, as shown in FIG. 2, is formed of six elongated structural elements 19, 20, 21, 22, 23 and 24, positioned in an end to end relation to form a regular hexagon and movably connected at their ends for limited relative angular motion about an axis transverse to the plane of the hexagon defined thereby. Thus, each structural element or arm of the hexagon is formed of a rigid bar, preferably of two inch by two inch wood stock, which, in the presently preferred embodiment, is cut to the nearly square but trapezoidal cross section illustrated in FIG. 3. Each arm or bar has planar and parallel side surfaces 28, 30 and an inner surface 32 perpendicular to the side surfaces. The perimetric outer surface 34 of each arm however, extends at an angle of 7½° with respect to a plane 36 that extends normal to the plane of the hexagon defined by the bars 19 through 24.

The particular cross sectional configuration of each of structural bars or arms 19–24 may be varied widely without departing from principles of the present invention, provided however, that the bars have significant structural strength and have a broad, flat outer surface 34 that extends at the indicated angle with respect to the plane of the hexagon. Although a flat outer surface 34 is presently preferred because this provides the proper angular orientation of the plane of one hexagon with respect to the plane of an abutting and adjoined hexagon, it will be readily appreciated that one may also employ non-planar surfaces that allow two hexagonal units to be interconnected with abutting surfaces mating so as to control the relative orientation of the planes of the two hexagons to an included angle of 165° (FIG. 5).

Adjoining ends of adjacent structural arms of each hexagon are movably interconnected as indicated in FIGS. 2 and 4. The several arms are interconnected by connector plates 40, 42, 44, 46, 48 and 50. All of the connector plates are identical to each other and, as illustrated in FIG. 4, for plate 40, each comprises a flat, metallic strap having first and second arms 52, 54 bent at an angle of 120° and fixedly secured to the inside surface at the ends of adjoining arms 19 and 20 by means of flatheaded bolts 56, 58, 60, 62. The head of the bolts that secure the connector to the arms are countersunk in and flush with the outer surface 34, which is oriented at an angle of 7½° with respect to a perpendicular to the plane of the hexagon. Thus, after assembly the surface 34 of one arm of one hexagon lies flush against a mating flat outwardly facing surface 34 of one arm of an adjoining hexagon, as shown in FIG. 5.

In an embodiment of the invention presently preferred each arm is formed with a pair of apertures for reception of bolts 68, 70 that securely connect abutting arms of adjoining hexagons in fixed face to face contiguity. FIG. 5 illustrates the typical connection of abutting arms of adjoining structural units, such connection being used throughout the assembly of the dome.

To completely define a hexagon at the outer perimeter of the hexagonal structural unit 12 illustrated in FIG. 2, the end of each of the hexagon arms would lie in a plane extending at 60° with respect to the longitudinal extent of the arm. However, since the arms are connected to each other in end to end relation for limited pivotal motion, the end surfaces cannot abut without restraining or restricting such pivotal motion, and the end surfaces must lie in a plane extending at an angle of greater than 60° with respect to the longitudinal extent or axis of the arm. Conveniently, for ease of manufacture, each arm has its end cut in a plane normal to the extent of the arm, as shown in FIG. 2. This orientation of the end surface at 90° to the longitudinal extent of the arm defines an angular recess between adjoining ends of each pair of arms of the hexagon.

Although many different ways are available for interconnecting the ends of the arms of a single hexagon for limited pivotal motion about an axis normal to the plane of the hexagon, it is found that the illustrated flat metallic connector plates 40, etc. have sufficient strength to hold the arms of the hexagon in their normal regular hexagonal configuration. It is the 120° angle between the arms of each connector plate that defines this regular hexagonal configuration. Nevertheless, the metallic connectors are sufficiently flexible so that they are readily deformable (either elastically or inelastically) so that the arms 19–24 may be pivoted relative to one another to achieve a limited amount of angular distortion of the initially regular hexagon.

The described regular hexagon is one of the two different shaped structural units employed in construction of the described dome. Only two different structural units are employed. The second of these is a semi-hexagon, illustrated in FIG. 6, which is nearly congruent with one-half of the full hexagon of FIG. 2. Each semi-hexagon is a modified regular half hexagon and is identical to every other semi-hexagon. Each semi-hexagon is formed of elongated structural elements or arms 76, 78, 80 and 82 interconnected in end to end relation to define the illustrated semi-hexagon by connectors 84, 86, and fixed, nondistortable connectors 88 and 90. Connectors 84, 86 are identical to the connectors of the full hexagon and comprise flat metallic plates having the arms thereof bent to define a 120° angle and fixedly connected to respective adjoining ends of adjacent structural elements of the semi-hexagon.

It is not necessary that relative pivotal motion be provided between the long arm 80 of the semi-hexagon and the two side arms 78 and 82. Accordingly, the ends of these elements are cut at the illustrated substantially 60° angles so that the ends of arm 80 lie flush against the inwardly facing surfaces of arms 78 and 82 and the ends of arms 78 and 82 lie in a common plane containing the outermost surface of arm 80. Connectors 88 and 90 which secure the arm 80 to arms 78 and 82 of the semi-hexagon are similarly formed of flat, metallic plates but these are bent at a 60° angle to lie in a plane parallel to the plane of the semi-hexagonal unit against the side surfaces of the arms. Preferably a pair of connectors 88 is connected at each acute angle joint of the semi-hexagonal unit on opposite sides of the arms and bolted together through the arms to provide a firm and rigid joint. The outermost surfaces of arms 76, 78, 80, and 82, like the outermost surfaces of all the arms of the hexagon lie in a plane extending at an angle of 7½° with respect to a plane normal to the plane of the semi-hexagon.

As indicated above, the semi-hexagon units are not precisely congruent with half of the regular full hexagonal units. Each of the short arms 76, 78, 82 is identical (except for the angle of one end of arms 78, 82) to each arm of a full hexagon. However, the long arm 80 is slightly shorter than the diagonal (a corresponding but non-existent arm extending between directly opposed corners of the full regular hexagonal unit and bisecting the unit) of the full unit. For example, if each diagonal of a full hexagon were twenty six and three quarter inches, the long arm of the semi-hexagonal unit is about 26¼ to 26½ inches. Thus, the angles of the semi-hexagonal unit are slightly changed. This configuration of the semi-hexagonal units improves the fit of all units in a dome structure and facilitates assembly as described below.

The described angularly deformable and regular hexagonal units, all of which are identical, together with the identical rigid semi-hexagonal units may be readily assembled into a dome structure that is of a generally part spherical configuration. When assembled to form an approximation of a hemisphere as illustrated in FIG. 1, the dome structure is formed of six equal segments of which a single segment is illustrated in solid lines in developed form in FIG. 7. Hexagon 100 of the segment of FIG. 7 is positioned at the top center of the dome structure and is common to all of the six segments. A first row of five full hexagons 102, 104, 106, 108 and 110 extends between the apical hexagon 100 and a base semi-hexagon 112. A plurality of full hexagons 114, 116, 118, 120 and 122 together with a lowermost semi-hexagon 124, fill in a lower portion of this substantially hemispherical segment and a full hexagon 126 is connected to and between the full hexagons 102 and 104. Hexagons 126, 102, 104, 106, 108, 114, 118, 116 and corresponding hexagons 117, 119, 121 of the next of the six segments of the hemisphere (partially illustrated in dotted lines) define a star-shaped figure having five semi-hexagonal branches.

In prior art devices attempts have been made to complete or partially fill this figure with additional full hexagons, resulting in a pentagonal figure having sides substantially equal to the sides of the hexagons. However, this requires different shapes and sizes of units which greatly complicated construction and assembly. According to the present invention, however, each of the five branches is filled in by semi-hexagons 128, 130, 132, 134 and 136 constructed as described above. These semi-hexagons thus define a substantially regular pentagon having sides equal to the longer side of the typical semi-hexagon.

Thus it will be seen, considering a hemispherical structure, that there are six continuous rows of full hexagons, such as hexagons 102 through 110, and similar rows of hexagons on the opposite side of the apical hexagon 100, making a complete half circle which extends along a great circle between semi-hexagons at the base of the structure.

Figure 8:
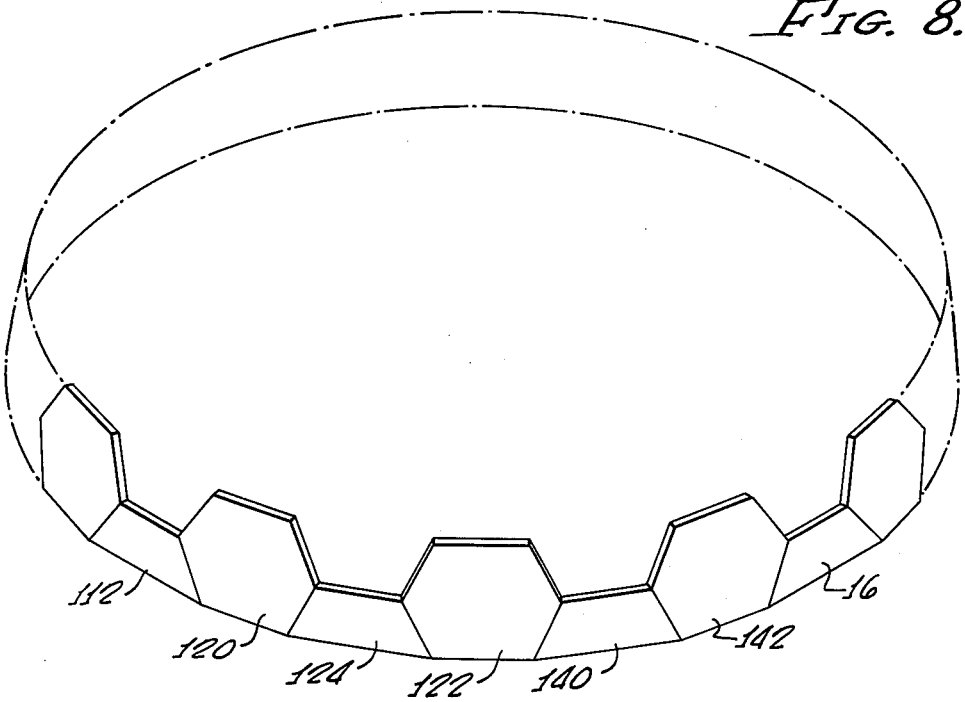
FIG. 8 illustrates one step in assembly of the dome structure.
Figure 9:
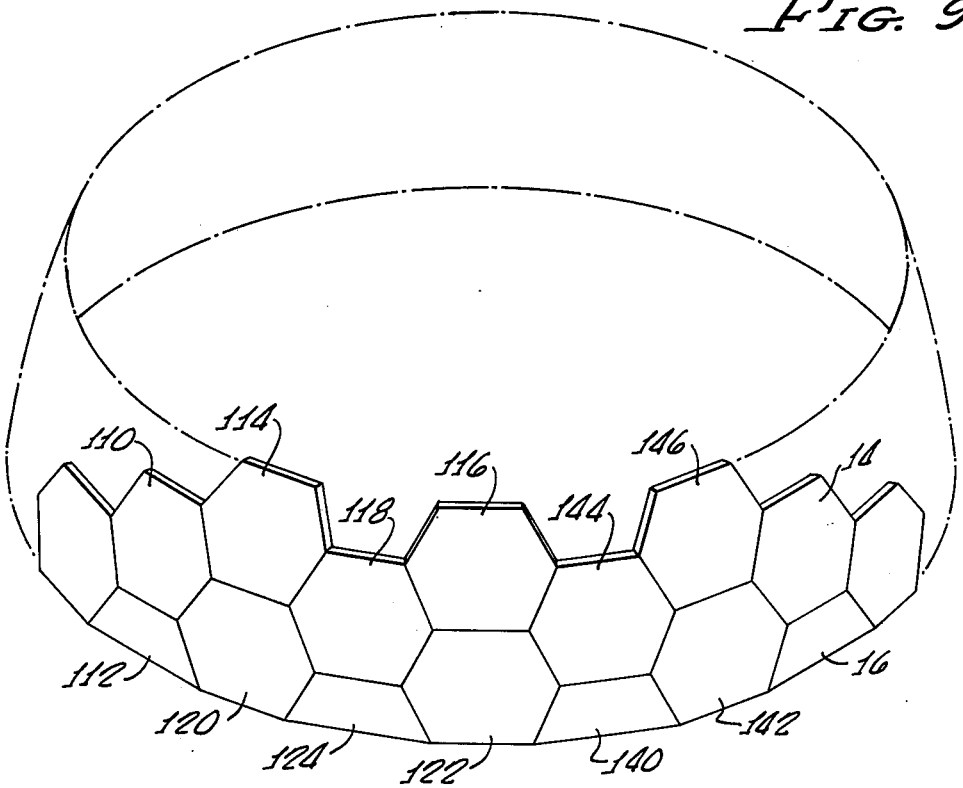
FIG. 9 illustrates a second step in the assembly of the structure.

In assembly of the structure of FIG. 1, several different procedures may be followed but certain orders of assembly are preferred for convenience and improved speed of assembly. Thus, after positioning the foundation blocks **10*a* and 10*b*, a lowermost first circumferential row of alternate full and semi-hexagons is laid out as schematically illustrated in FIG. 8, comprising hexagons 112, 120, 124, 140, 142. These are secured to the foundation blocks in a conventional manner as by bolts fixed to the foundation and extending through lowermost arms to the structural units. The full hexagons are bolted to the semi-hexagons and the abutting faces of the adjoining arms as previously described and in the manner illustrated in FIG. 5 for the interconnection of adjoining full hexagons. Then a second circumferential row (schematically shown in FIG. 9) of full hexagons 110, 114, 118, 116, 144, 146, etc. is positioned upon the first row and bolted to the hexagons and semi-hexagons of the first row and to each other. The positioning of each unit relative to an adjacent unit or units is greatly facilitated by the wide flat surfaces (such as surfaces 34**) of the abutting arms and by the fact that all hexagonal units are identical and can be placed in any position and at any orientation. No templates or assembly plans are required. Each unit is readily guided into position by contact with previously assembled units with which it is manually placed in firm and with full face to face contact of the outer surfaces of the abutting arms.

Figure 10:
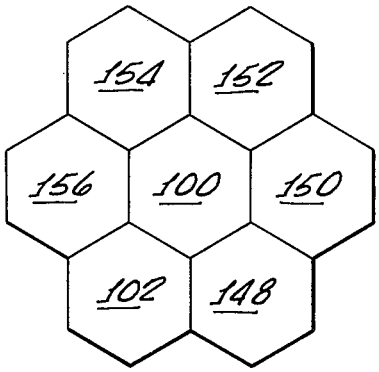
FIG. 10 illustrates a third step in the assembly of the structure.

As a separate step which may be carried out before or after either one or both of the previously mentioned steps of the assembly of the structure, an apical sub-assembly is formed as schematically shown in FIG. 10, including the apical hexagon 100 and six hexagons, 102, 148, 150, 152, 154 and 156, bolted to the six sides thereof and to each other.

Figure 11:
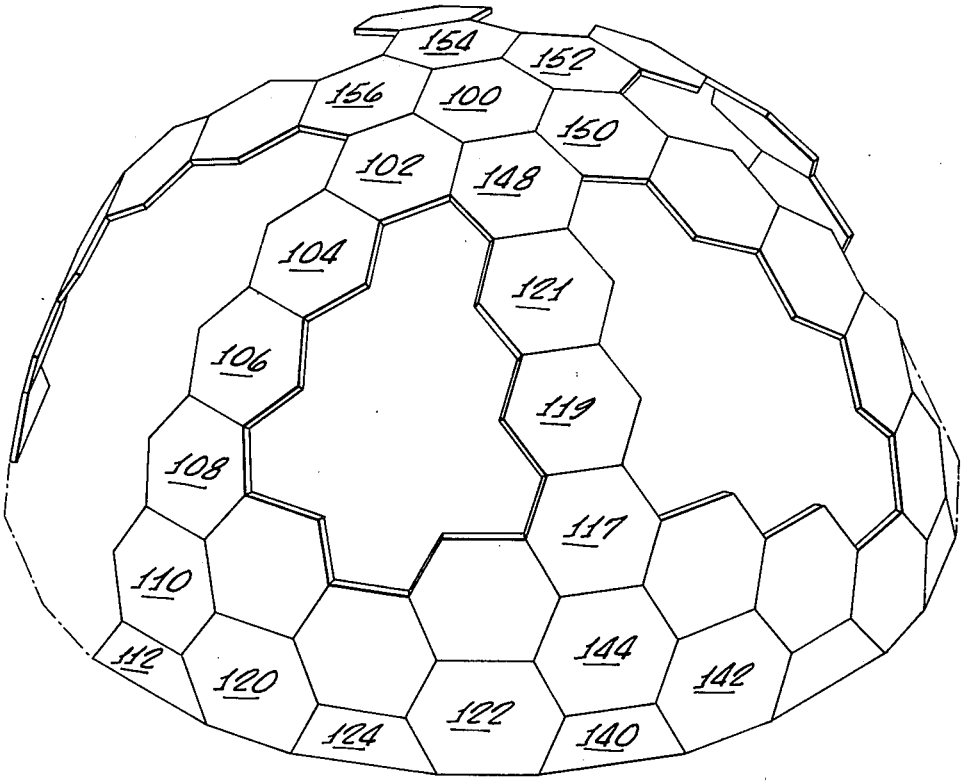
FIG. 11 illustrates a fourth step in the assembly of the structure.

Now two or more of the complete upwardly extending quarter circle rows of continuous hexagons, such as the row 102 through 110 of FIG. 7, are completed as for example, by adding hexagons 108, 106 and 104 to hexagon 102, adding three full hexagons 117, 119, 121 extending upwardly from hexagon 144 and similar groups of three full hexagonal units to one or more of the corresponding lower full hexagons to form lower portions of the six continuous great circle lines of full hexagons. Having formed several or all of these great circle lines of full hexagons that extend to the apical sub-assembly of FIG. 10, this apical sub-assembly is then placed upon the uppermost hexagons of these great circle lines of full hexagons and bolted thereto to achieve the partial structure schematically illustrated in FIG. 11. Now additional full hexagons and semi-hexagons are positioned and secured in place to provide the complete substantially hemispherical dome structure illustrated in FIG. 1. For such a full hemispherical dome structure there are 67 full hexagons and 42 semi-hexagons. The dome structure is formed of six identical segments each of which is identical to the segments illustrated in developed form in FIG. 7 (with apical hexagon 100 being common to all) and thus there are six pentagonal openings equally spaced around the perimeter.

Rigid planar structural units of the described regular hexagonal shape, all of which are identical to each other, together with the described planar semi-hexagons, cannot form a fully enclosed structure. The full great circle row of hexagons such as the row including hexagons 100 through 110, does in fact form a tight fully closed figure defining chords of a half circle and extending for a full 180° because of the specifically chosen 7½° angles of the abutting surfaces of adjoining hexagons. However, as the other hexagons are assembled or attempted to be assembled with the outwardly facing surfaces of the arm in face to face abutment, it will be found that the succeeding hexagons do not precisely fit into the recesses formed by those hexagons already assembled. Therefore, although the recesses formed by adjoining assembled hexagons of a partly assembled full structure are of a partly hexagonal shape, they are in fact, somewhat distorted partial hexagonal recesses. Thus, in order to closely position and secure succeeding hexagonal structural units into the deformed part hexagonal recesses, one must employ angularly distorted hexagons. Rather than attempt to define such angular distortion and the specific location and orientation of each of such distortions in and among the various recesses of partly assembled structures, applicant's invention permits the use of hexagonal structural units all constructed as regular hexagons and all constructed exactly identical to one another. However, the construction of individual units is such that these identical regular hexagons may be readily angularly deformed. Therefore, it is only necessary to take one of these regular hexagons, insert it into an irregular part hexagonal recess and manually press it into place, thus slightly bending the several connectors such as connector 40 (FIG. 4) and angularly distorting the hexagon until it properly and perfectly mates with the adjoining hexagons. The magnitudes of the angular distortions of the recesses are small, on the order of a few degrees, and thus the arms of the described structural units may be readily pivoted relative to one another by the limited amount necessary to insure a precise interfitting relation and a full face to face contact of abutting surfaces 34.

The plane of each of the lowermost hexagons and semi-hexagons (units 112, 120, 124, etc.) is tilted outwardly by a small amount which adds to the $7\frac{1}{2}°$ angle of the surface of the units' lower arm to present an inwardly opening angular space between the foundation (if the upper surface of the latter is horizontal) and the lower unit surface. This space may be accepted in many situations, or the foundation may be formed with its upper surface inclined downwardly and outwardly by approximately 15° to provide a greater bearing contact of the lower units. It is understood that the contact between units of each pair of adjoining units is full and complete over the entire surface 34 of each of the abutting arms.

Since little or no distortion from the regular hexagonal shape is required of the hexagons in the lowermost circumferential row, these can be made rigid and thus enhance rigidity of the overall structure. Thus, the two lower joints between arms of each of lowermost hexagons such as hexagons 120, 122, 142, etc. may have rigid, non-bending connector plates 170, 172, etc. (FIG. 1) fixed in pairs to opposite sides of the arms at such joints and bolted to each other through the hexagon arms, just like rigid connectors 88, 90 of the long arms of the semi-hexagons.

For a completed structure, the hexagonal skeletal frames may be covered in any one of a number of arrangements well known to those skilled in the art. Thus, conventional woven or reticulated wire or the like may be fixed to the skeletal frame together with conventional building paper and plaster. Other types of flexible or sectional sheathing may be applied either to the inside or outside or both. Some or all of such sheathing may be applied either before or after assembly, or both.

Figure 3:
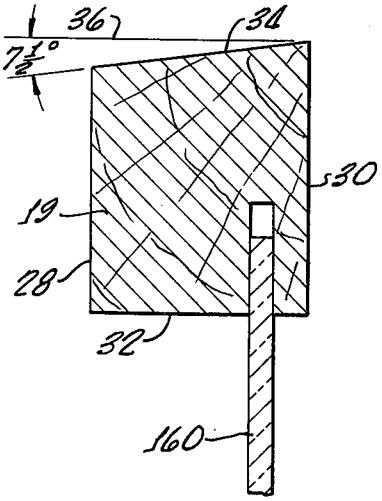
FIG. 3 is a section take on lines 3—3 of FIG. 2.

For a greater degree of prefabrication, each of the skeletal hexagons may itself be provided with finished sheeting or panels secured to the inside or the outside of each hexagonal and semi-hexagonal unit. For use as a greenhouse, for example, each of the arms of each skeletal hexagon (and semi-hexagon) may be dadoed or grooved as illustrated in FIGS. 3, 4 and 5, and a flat self-supporting, rigid, translucent or transparent panel 160 of plastic or glass may be inserted in and captured by the dadoes in the six arms as the arms are assembled to one another. In such an arrangement the dado is laterally displaced from the longitudinal axis of the arm and the connector has a width somewhat less than the distance between the dado and the far side of the arm. The panel 160 has dimensions, measured in the plane of the panel, which are less than the dimensions between the bottom portions of oppositely disposed and facing grooves or dadoes. Thus, although the thickness of the panel with respect to the thickness of the dado is such that the panel is a snug fit within the dado, it is nevertheless movable relative to the arms of the hexagonal frame in any direction parallel to the plane of the panel. This capability of relative sliding motion between the panel and the frame allows the necessary limited angular distortion of the hexagonal frame arms without excessively stressing the panel. Thus, with a panel secured to the frame, the several regular identical hexagonal structural units can be readily assembled to form a nearly complete and closed finished dome structure.

Figure 12:
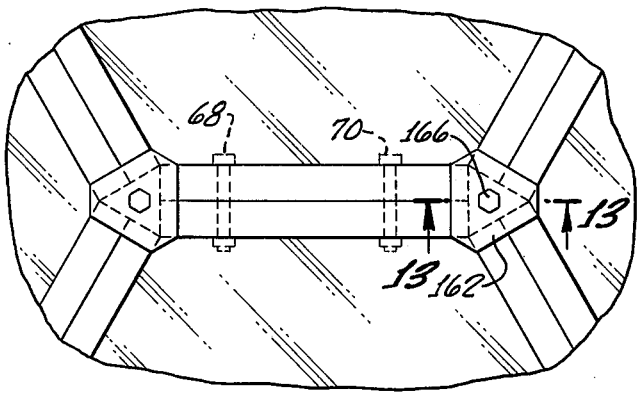
FIGS. 12 and 13 illustrate details of the arrangement for closing the openings at junctions of three structural units.
Figure 13:
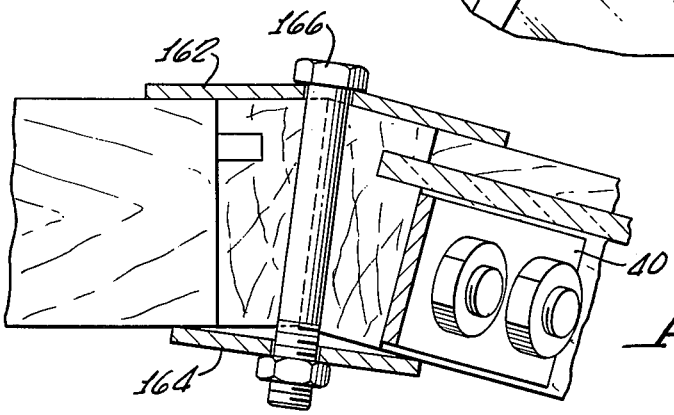

Because the ends of the arms of each hexagon lie in a plane extending at an angle of more than 60° with respect to the axis of the arm, there is a substantially triangular shaped space defined between adjoining ends of three of the structural units that are connected together (see FIG. 12). Each such triangular space is readily covered by one or a pair of cover plates 162, 164 suitably secured to the adjoining hexagons. Preferably, a pair of these plates 162 and 164, each shaped to cover the triangular openings and bent to conform to the angular orientation of the planes of the joined hexagons, is secured to the hexagon at the inside and outside of the triangular shaped opening by means of a single bolt 166 that extends through the two plates that cover any one opening. Thus, when the dome structure is formed with panels and is not otherwise sheathed or covered so that the triangular openings exist, each of these openings is conveniently covered by a pair of plates such as plates 162 and 164 after the assembly of the structural units has been completed.

The pentagonal openings are defined by the illustrated five semi-hexagons which, in turn, are secured to the several full hexagons. There is no pentagonal structural unit employed in construction of this dome. The pentagonal openings may be closed in any desired fashion. Conveniently, each is divided into a trapezoid and triangle by inserting a horizontal structural member 165 (FIG. 1), spanning opposite corners of the pentagon and secured to oppositely disposed semi-hexagons or pairs of semi-hexagons. Member 166 divides the pentagon into a planar trapezoid and a planar triangle which lie in planes that are angulated with respect to one another. These planar openings may be readily covered or filled with glass or other material or closure panels as may be necessary or desirable.

Employing hexagons having arms of about 15 inches in length there is formed a substantially hemispherical dome structure of about 8 feet in height and approximately 14 feet in horizontal diameter. If smaller or larger structures are desired, the size of the regular identical hexagons is changed simply by changing the length of each of the arms of the structural units.

The exemplary structure illustrated in the drawings described herein is of substantially hemispherical configuration. It will be readily appreciated that portions of a sphere other than a hemisphere may be employed and thus provide a structure of different ratio of height to diameter. For example, to provide a structure that is lower in proportion to its diameter, one simply may omit the first two circumferential horizontal rows of the structure, those rows shown in FIGS. 8 and 9. In such an arrangement the foundation blocks 10*a*, 10*b* would be immediately under the lowermost horizontal arm of the pentagon and thus a pentagonal opening would extend from the foundation block upwardly. In such an arrangement, some of the full hexagons illustrated in FIG. 1 as being placed in the third row would be replaced by semi-hexagons. Thus, a hexagon such as hexagon 108 would be a semi-hexagon with its long arm horizontal and resting upon the foundation.

Suitable additional openings such as doors or additional windows may be cut and framed into the completed structure in any one of a number of different configurations and locations. For example, in the structure of FIG. 1 and as partly illustrated in dotted lines, a door jamb may extend vertically downward from the intersection of hexagon 114 with semi-hexagons 132 and 130 to the lower junction of hexagon 120 and semi-hexagon 124 with the foundation. A similar door jamb may extend downwardly from the junction of hexagon 116 with the junction of semi-hexagons 132 and 134, to the junction of hexagon 122 with semi-hexagon 124 at the foundation. Structural units of hexagons and semi-hexagons between such jambs, of course, would be removed and replaced by a suitable door or other opening. The door may extend up into the pentagonal opening above semi-hexagon 132 and likewise the jambs may also extend to the top or any intermediate portion of the pentagonal opening.

The semi-hexagons 128, 130, 132, 134, 136 surrounding each pentagon may be omitted and the resulting star-shaped opening may be filled in by uniquely shaped full hexagons, producing a smaller pentagon. However, these full hexagons must not only be uniquely shaped and dimensioned, but they must be uniquely oriented and positioned.

There have been described dome structures, structural units therefore and methods of construction that enable mass production by employing identical regular and angularly distortable hexagonal units together with semi-hexagons constructed with specific 7½° face to face bearing surfaces to facilitate positioning and supporting cooperation of one hexagonal structural unit upon another and to minimize the variation in size and shape of the several recesses. The angularly distortable construction of the identical units enables these to fit distorted recesses to form a complete, strong and stable structure of greatly simplified construction and assembly.

The foregoing detailed description is to be clearly understood as given by way of illustration and example only, the spirit and scope of this invention being limited solely by the appended claims.

I claim:

1. The method of building a dome structure comprising the steps of constructing a plurality of regular, identical, hexagonal structural units of rigid interconnected arms, interconnecting said units in side to side abutting relation to form a dome structure, said last mentioned step comprising distorting at least some of said units after other units have been assembled and interconnected with each other so as to improve the interfitting relations of unconnected units to the already connected units, and connecting said distorted units to units that have been connected.

2. The method of claim 1 wherein said steps of constructing units comprising movably interconnecting said unit arms in end to end hexagonal configuration, and wherein said step of distorting at least some of said units comprises angularly moving one arm of one of said units with respect to at least an adjoining arm of said one unit.

3. The method of claim 1 wherein said step of constructing said units comprises interconnecting a plurality of in a hexagonal configuration with limited freedom of relative angular motion about an axis transverse to the plane of the hexagon formed thereby.

4. The method of claim 1 including the step of constructing a plurality of semi-hexagonal units each identical to each other and each substantially congruent with one-half of one of said hexagonal units, and connecting said semi-hexagonal units with said hexagonal units.

5. The method of building a dome structure comprising constructing a plurality of identical, regularpolygons, assembling and interconnecting a first group of said polygons to form part of a dome structure having distorted partial polygonal recesses, distorting others of said polygons in the planes of such polygons to fit said recesses after said construction thereof, and assembling and interconnecting said distorted polygons to said first group of polygons.

6. The method of claim 5 wherein some of said polygons are hexagons and some of said polygons are semi-hexagons.

7. The Method of building a dome structure comprising constructing a plurality of identical, regular polygons, assembling and interconnecting a first group of said polygons to form part of a dome structure having distorted partial polygonal recesses, distorting others of said polygons in the planes of such polygons to fit said recesses, and assembling and interconnecting said distorted polygons to said first group of polygons, some of said polygons being hexagons and some of said polygons being semi-hexagons, said step of constructing (comprises) comprising movably interconnecting a plurality of elongated rigid elements in end to end relation to form a distortable hexagon.

8. The method of building a dome structure comprising constructing a plurality of identical, regular polygons, assembling and interconnecting a first group of said polygons to form part of a dome structure having distorted partial polygonal recesses, distorting others of said polygons in the planes of such polygons to fit said recesses, assembling and interconnecting said distorted polygons to said first group of polygons, some of said polygons being hexagons and some of said polygons being semi-hexagons, said step of constructing (comprises) comprising movably connecting a plurality of rigid elements in end to end relation for limited relative angular motion about an axis transverse to the plane of the polygon defined thereby.

* * * * *

UNITED STATES PATENT AND TRADEMARK OFFICE

CERTIFICATE OF CORRECTION

PATENT NO. : 4,075,813

DATED : Feb. 28, 1978

INVENTOR(S) : David L. Nalick

It is certified that error appears in the above-identified patent and that said Letters Patent are hereby corrected as shown below:

Col. 10, line 9: after "of" and before "in" insert ---said rigid arms---;

Col. 10, line 45: delete "(comprises)";

Col. 10, line 62: delete "(comprises)".

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*